US008701690B2

(12) United States Patent
Warner

(10) Patent No.: US 8,701,690 B2
(45) Date of Patent: Apr. 22, 2014

(54) HORIZONTAL FRAME TENSILE STRUCTURE AND CANTED CORNER ELEMENTS THEREFOR

(75) Inventor: Gerhard Allan Warner, Surrey (CA)

(73) Assignee: 0798555 B.C. Ltd., Surrey, BC (CA)

( * ) Notice: Subject to any disclaimer, the term of this patent is extended or adjusted under 35 U.S.C. 154(b) by 0 days.

(21) Appl. No.: 13/202,413

(22) PCT Filed: Feb. 20, 2009

(86) PCT No.: PCT/CA2009/000358
§ 371 (c)(1),
(2), (4) Date: Aug. 19, 2011

(87) PCT Pub. No.: WO2010/094103
PCT Pub. Date: Aug. 26, 2010

(65) Prior Publication Data

US 2011/0297199 A1 Dec. 8, 2011
US 2012/0180837 A9 Jul. 19, 2012

(51) Int. Cl.
*E04H 15/34* (2006.01)

(52) U.S. Cl.
USPC ..... 135/121; 135/158; 135/120.3

(58) Field of Classification Search
USPC ..... 135/121, 122, 123, 906, 907, 157, 158, 135/160, 120.3
See application file for complete search history.

(56) References Cited

U.S. PATENT DOCUMENTS

| | | | | |
|---|---|---|---|---|
| 1,267,084 | A * | 5/1918 | Knox | 52/86 |
| 3,810,481 | A * | 5/1974 | Nohmura | 135/158 |
| 4,052,834 | A | 10/1977 | Ellen | |
| 4,793,371 | A * | 12/1988 | O'Ferrell et al. | 135/160 |
| 5,651,147 | A | 7/1997 | Steele et al. | |
| 5,930,971 | A * | 8/1999 | Etheridge | 52/646 |
| 6,893,364 | B1 * | 5/2005 | Grunfeld | 473/446 |
| 7,219,681 | B1 * | 5/2007 | Hamilton-Jones | 135/123 |
| 7,921,863 | B2 * | 4/2011 | Ways | 135/125 |
| 2003/0000563 | A1 * | 1/2003 | Kuperman | 135/121 |
| 2003/0034061 | A1 * | 2/2003 | Warner | 135/144 |
| 2004/0237423 | A1 | 12/2004 | Carter | |
| 2006/0283493 | A1 * | 12/2006 | Charles | 135/121 |
| 2007/0295378 | A1 * | 12/2007 | Lapping | 135/121 |

OTHER PUBLICATIONS

PCT/CA2009/000358 Preliminary Report on Patentability dated Sep. 1, 2011 (2 pages).

International Search Report and Written Opinion, mailed Oct. 29, 2009, in related PCT patent application No. PCT/CA2009/000358.

* cited by examiner

*Primary Examiner* — Noah Chandler Hawk

(74) *Attorney, Agent, or Firm* — Michael Best & Friedrich LLP

(57) ABSTRACT

The present invention relates to horizontal frame tensile structures ("HFTS") of the kind employing corner elements to interconnect beams and posts. The corner elements of the invention comprise 1) two arms that engage the ends of adjacent beams, and 2) a leg that engages the top of a post. The arms are splayed so as to produce canted corner angles. Optionally, or additionally, the leg angle of the corner element is canted. Canting the corner angle and/or the leg angle causes the beams to bow upwards and/or outwards, thereby effectively increasing the angle in the horizontal plane between adjacent beams. This bow in the beams is reduced or eliminated when the membrane is attached to the frame, thereby providing straight beams and an aesthetically pleasing profile and introducing beneficial increased tension into the frame.

20 Claims, 4 Drawing Sheets

HORIZONTAL FRAME TENSILE STRUCTURE AND CANTED CORNER ELEMENTS THEREFOR

BACKGROUND OF THE INVENTION

1. Field of the Invention

The present invention relates to frame corner elements of tensile horizontal frame tensile structures such as tents, awnings, canopies, and the like.

2. Description of Related Art

The present invention is disclosed herein with respect to tensile frame tents; however, the scope of the invention includes all tensile frame structures employing a substantially horizontal polygonal frame comprising elongate beams that form the sides of the polygonal frame, supported by vertical posts. Examples in addition to tents include, for instance, awnings and canopies. Such structures are referred to herein generically as "horizontal frame tensile structures" or "HFTS."

Horizontal frame tensile structure type tents are well known. The shape of such a tent as viewed from above is usually a regular polygon having n corners and n sides, where n is an integer greater than 2. At each corner is a corner element. Corner elements are generally pre-formed structures that connect frame beams and posts at each corner. Beams are the elongate, horizontal frame members that form the sides of the polygonal frame. Beams are also commonly referred to as "eaves." Posts are vertical frame members that hold the horizontal polygonal frame above the ground or other supporting surface.

A membrane, as the term is used herein, refers to a fabric covering that is placed over the frame to provide the roof of the HFTS. In some contexts "membrane" also includes fabric sides of the HFTS. The membrane may be made of, for instance, canvas, nylon, rubberized fabrics, and the like. The type of fabric need not be specified here as it will be chosen in response to design criteria.

FIG. 1 shows a typical HFTS in the form of a square cross-cable frame tent 100. For the sake of clarity only one example each of a plurality of identical elements is shown and/or numbered. At the corners of the tent are corner elements 107, which join the beams 101 to produce the polygonal frame. Posts 102 support the polygonal frame above the ground or other surface. Typically, guys 106 secure the HFTS to the pegs 105 driven into the ground. A membrane 103 is tensioned over the frame, forming a roof. The peaks 104 of the roof in this example are supported by an internal flying pole and cable network (not shown). Other types of HFTS tents may employ a single central peak supported by a mast. The invention disclosed herein accommodates these and other types of tensile frame structures.

Although the arms and legs shown herein are depicted as hollow tubes for receiving the beams and posts, respectively, these connecting elements may take a number of cross-sectional profiles such as polygonal, ovoid, and elliptical. The arms and legs may be solid and received by hollow beams or posts. Or they may be more complex, interlocking structures. What is relevant to the present disclosure is not the form of the elements and connector mechanisms but the size of the angles formed by the connectors with respect to each other. It is these angles that determine the orientation of the beams and posts.

The corner elements typical in the art comprise a plurality of connectors for interconnecting beams and posts. There are normally two horizontal connectors that engage the ends of adjacent beams. Such connectors are referred to herein as "arms." The connectors for posts are referred to herein as "legs." Normally there is one post, and hence one leg per corner unit.

Each pair of arms of a corner element receives or engages the ends of two adjacent beams, maintaining the ends of the beams in fixed positions relative to one another. The interior angles of the polygonal frame formed by the arms are referred to herein as "corner angles." In regular polygonal prior art structures the corner angles are equal and are determined by the formula: $[(n-2)180]/n$ degrees, where n is the number of corners or number of sides. A corner angle that equals or approximates this formula is referred to herein as "standard" in order to distinguish it from canted corner angles produced by the invention as disclosed below. By way of example, standard corner angles for some common HFTS's are as follow: triangle—60°; square/rectangle—90°; hexagon—120°; octagon—135°. "Canted corner angles" as that term is used herein refers to corner angles wherein the arms are splayed such that they form a corner angle greater that the standard corner angle.

A second important angular component of the corner element is the angle between the arms and the leg. This angle, referred to herein as the "leg angle" determines the angular orientation of the post to the beams. In present art HFTS's this angle is 90°. "Canted leg angles" as that term is used herein refers to leg angles that form more than 90°.

Once the posts and beams are interconnected by means of the corner elements, a membrane is attached to the perimeter of the polygon thus formed, thereby forming the roof of the structure. In some applications the membrane may include walls attached to the beams.

FIG. 2 shows corner element 200 as commonly used in existing square or rectangular HFTS tents. The existing art corner element typically has two arms 210 and 211 for receiving beams (not shown) of the frame. Each arm has an axis, 210*a* and 211*a*, respectively. Leg 212 receives the upper end, or top, of a post (not shown), on which the corner element will be supported when the tent is assembled. The leg has its own axis 212*a*.

As shown in FIG. 3, in existing corner elements, the corner angle "A" formed by arm axes 210*a* and 211*a* is standard; that is, for a rectangular or square frame the corner angle is 90°. As shown in FIG. 4 in existing corner elements, the leg angle "B" between leg axis 212*a* and arm axis 211*a* is also 90°. The leg axes of existing structures is always 90° irrespective of how many sides the polygon has.

Prior art HFTS's have a number of problems that are not associated with other types of tensile structures. Because existing HFT's have standard corner angles and leg angles, when the frame is initially assembled and unstressed, each beam is generally straight and normal to its adjacent beams; and the posts are vertical and normal to the beams. However, when such a frame becomes stressed by the weight of the canopy, walls or other tent membranes, the elongate components bend out of their original alignment and configuration, with the beams bending inward and sagging downward, as shown for beam 101 in FIG. 1. An additional source of this distortion is that in order to assemble the frame and fit the posts a certain amount of play or clearance between the corner elements and their connecting components is necessary. Once the frame is assembled, this play exacerbates the sagging of the horizontal components. As a result of the loose and sagging beams, the frame becomes deformed and the tent is susceptible to a host of problems such as:

1) Water ponding;

2) Decreased aesthetic appeal due to wrinkles in the membrane;

3) Uneven distribution of membrane stresses thereby negatively affecting the weight-bearing ability and wind performance of the structure.

4) Gaps between adjacent tents causing water to fall between the tents rather than being channelled away to the perimeter by a gutter.

5) Decreased overall stability of the structure because of uneven distribution of stress to the membrane and slack connections between slip-fit parts.

The foregoing problems are overcome by the present invention, as disclosed below.

SUMMARY OF THE INVENTION

This invention represents a substantial and valuable improvement in the art of HFTS's, particularly cross-cable tent structures, by providing corner elements that have canted corner angles and/or leg angles that induce beneficial preload stress of the frame. The term "canted" as used with respect to corner angles herein means that the corner angle is larger than the standard corner angle for the polyhedron shape of the structure as a result of at least one of the arms being splayed from the standard angle. When used in reference to a leg angle, "canted" means the leg angle is more than 90°.

The corner elements of the invention comprise 1) two arms that engage the ends of adjacent beams, and 2) a leg that engages the top of a post. The arms are splayed so as to produce canted corner angles. By maintaining both ends of a beam in a canted angular relationship, bowing is introduced into the beam when the frame is assembled. For example, in a rectangular HFTS according to the present invention, each beam must bow in order to close the rectangle because the angle between adjacent beams at each corner element is greater than 90°. When the membrane is placed over the frame, the beams are forced to straighten in order to accommodate the edge of the membrane. This straightening of the beams introduces beneficial additional tension into the frame.

Optionally, or additionally, the leg angle of the corner element of the invention is canted. This causes the posts on which the frame is supported to splay outwards during the assembly of the frame. However, when the frame is put in position, the posts are forced inwards to a vertical orientation and their lower ends are braced against the ground. This causes the arms of the corner element, and, hence, the beams, to bow upwards, thereby effectively increasing the angle in the horizontal plane between adjacent beams. This upward bow in the beams is reduced or eliminated when the membrane is attached to the frame, thereby providing straight beams and an aesthetically pleasing profile and introducing beneficial increased tension into the frame.

The scope of the invention includes any HFTS having any combination of canted and non-canted corner angles and leg angles. This includes structures in which at least one, but not all, corner angels and/or leg angles are canted, and canted corner angles produced as a result of one or both legs of the corner elements being splayed. Two preferred exemplary embodiments of the present invention are disclosed.

A first preferred embodiment has canted leg angles and standard corner angles. For example for an equilateral triangle HFTS, the corner angles are standard—that is, 60°. However, the angle between the leg and the arms is greater than 90°. Therefore, when the leg is vertical, the arms are splayed upwards causing the beams to bow upwards. One advantage of this embodiment is that it is easily assembled by hand by one person, since no bowing need be introduced in order to connect the corner elements to the beams. The bowing is only introduced to the structure once the posts are connected to the legs and then aligned vertically. The weight of the membrane and/or the pressure produced by the guy wires counteracts the bowing and in so doing straightens the beams and introduces beneficial additional tension into the structure.

A second preferred embodiment employs canted corner angles and standard leg angles. For example for an equilateral triangle HFTS, the corner angle is greater than 60° so that the beams are forced to bow outwards before the membrane is attached. The weight of the membrane and/or pressure produced by the guy wires straightens the beams, thereby introducing beneficial additional tension into the frame.

Optionally, both embodiments can be combined so that both the leg angles and the corner angles are canted. Depending on the degree of canting of arms and legs of the corner elements, substantial bowing of the beams may be introduced when they are connected to the corner elements. This produces the greatest increase in additional, beneficial tension into the frame, but may make it difficult for one person to assemble the structure unaided.

In each embodiment a membrane is positioned over the frame, attached to the frame, and tensioned. The tension and weight of the membrane counteract the bowing of the beams induced by the canted angles, tending to straighten the beams. In other words, when the tensile structure is fully assembled, the upward and outward bowing of the beams is counterbalanced by the weight and tension of the membrane, resulting in a relatively straight beam, as opposed to prior art structures wherein the beams sag or bend as a result of the membrane's weight. Straight beams decrease the potential for water ponding, improve guttering, and improve the aesthetics of the structure.

The invention is easily adaptable to cross-cable structures wherein the corner elements have attachment points for internal cables. The cables support one or more flying poles, which support the membrane. In such embodiments the only frame elements extending down to the ground are the posts extending from the legs of the corner elements.

The present invention greatly enhances the performance of tensile frame structures, providing the following benefits with minimal or no increase in manufacturing or assembly cost:

1) Whereas the beams of conventional HFTS's experience a downward and inward sag due to the weight and tension of the membrane, the beams of the present invention are substantially straight or cambered slightly upward and/or outward once the membrane is attached.

2) The compression bearing ability of the frame members that acts mostly as columns is improved. This enhances the tent's performance under snow-loading and wind conditions.

3) The attachment of tensioned membrane walls is possible, which was heretofore not practicable. The walls hang more neatly and wall sculpting is not required to eliminate beam sag.

4) Distribution of membrane stresses is more uniform, which improves wind performance.

5) Since the stressed beams are straight, there is no space between the beams of adjacent tents; consequently, beneficial guttering is improved.

6) The overall stability of the structure is improved because there is no slack between slip-fit parts.

7) The even tensioning the frame by employing canted corner elements, provides a stronger HFTS, without having to add more material and/or guys for the added strength.

8) Due to its simplicity, the canted corner elements are particularly useful for cross-cable tent-like structures.

BRIEF DESCRIPTION OF THE DRAWINGS

Further features and advantages will be apparent from the following detailed description of preferred embodiments taken in conjunction with the accompanying drawings. The figures are not necessarily drawn to scale, particularly thickness and angles.

DETAILED DESCRIPTION WITH REFERENCE TO THE DRAWINGS

Structure

For simplicity and clarity of description, the examples and embodiments of this disclosure are generally rectangular or square HFTS's; however, the innovations disclosed herein apply to any tensile frame structure having a substantially horizontal polygonal frame.

Figure 1:
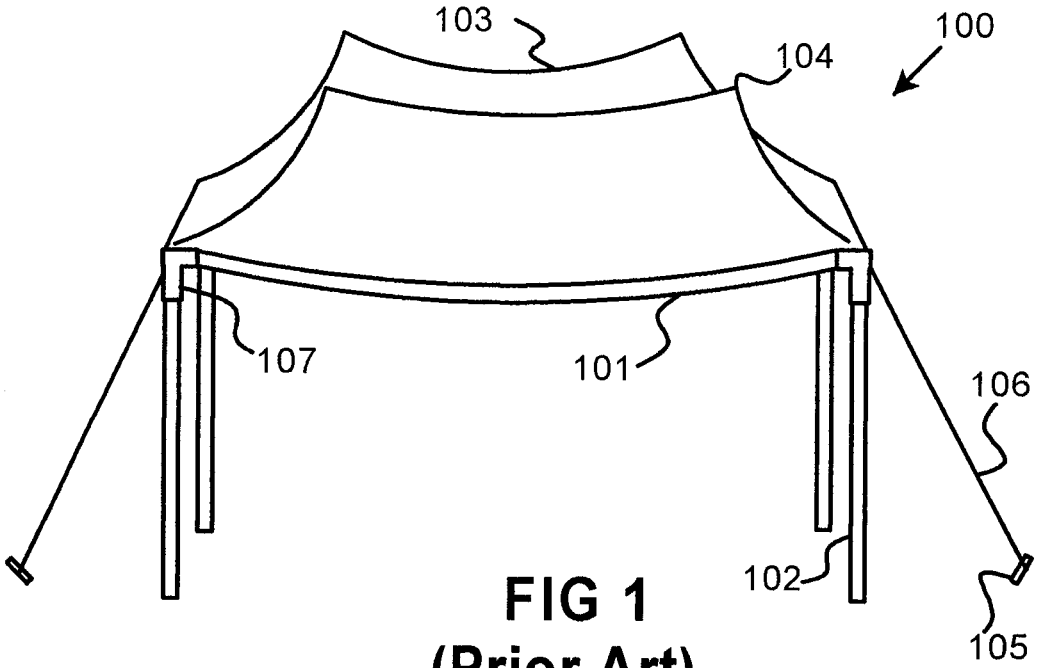
FIG 1 (Prior Art)
FIG. 1 is a perspective view of a square cross cable frame tent according to the prior art, as discussed above.
Figure 2:
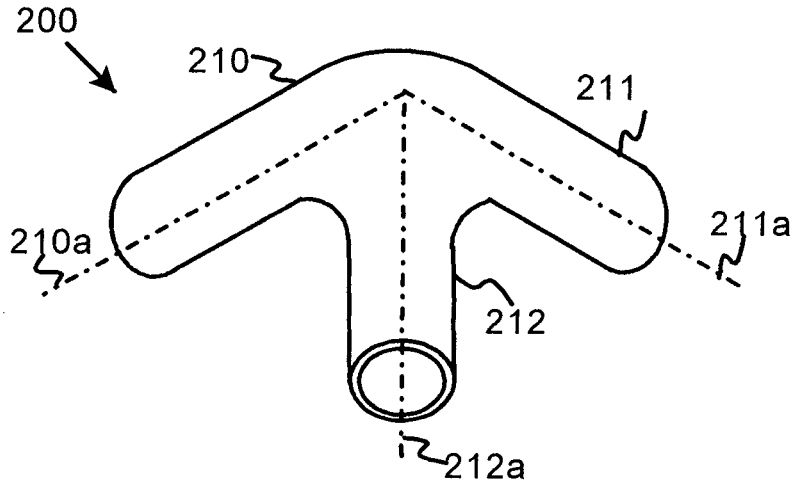
FIG 2 (Prior Art)
FIG. 2 is a perspective view 90-degree corner joint according to the prior art, as discussed above.
Figure 3:
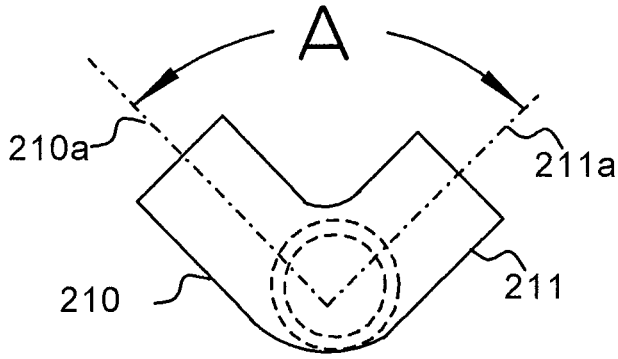
FIG 3 (Prior Art)
FIG. 3 is a top elevation of the corner joint of FIG. 2.
Figure 4:
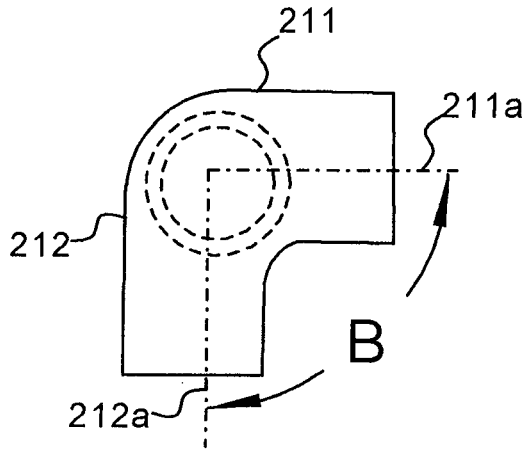
FIG 4 (Prior Art)
FIG. 4 is side elevation of the corner joint of FIG. 2.
Figure 5:
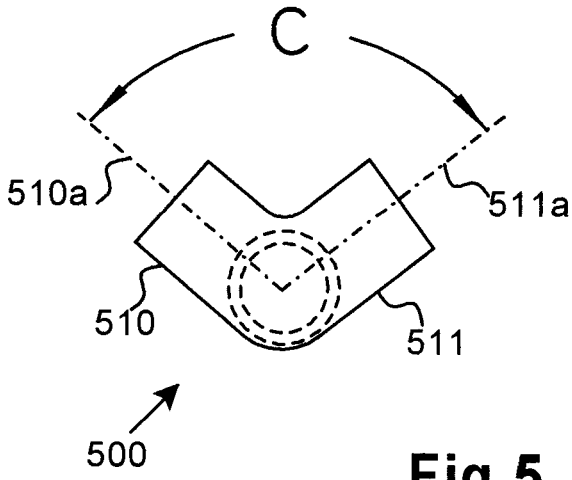
FIG. 5 is a top elevation of a corner element according to a preferred embodiment of the invention.
Figure 6:
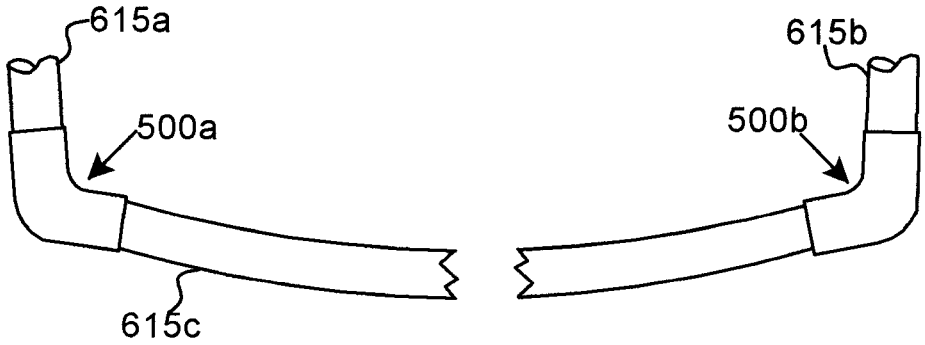
FIG. 6. is a top elevation of beam attached to two corner elements according to the invention.

FIG. 5 shows a top view of a corner element 500 for a square or rectangular HFTS wherein the corner element has a canted corner angle according to the present invention. The corner element 500 has two arms 510 and 511 for receiving the ends of the beams. Each arm has its respective axis, 510*a* and 511*a*. FIG. 6 shows a pair of canted corner elements 500*a* and 500*b* engaging beams 615*a-c* of the frame.

As shown in FIG. 5, the arms of corner element 500 are canted such that corner angle "C" is greater than a standard corner angle, which means greater than 90° in a square or rectangular HFTS. In one preferred embodiment of a square/rectangular structure, the canted corner angle is about 92°, although the degree to which the angle will exceed 90° will be determined by a number of factors such as the length of the beams, the materials used to construct the beams, and the amount of additional tension required.

Because the corner angle exceeds 90°, beam 615*c* connecting corner elements 500*a* and 500*b* acquires a slightly bowed configuration, as shown in FIG. 6. In order for this bowing to occur, the beam must be sufficiently deformable along its long axis. When the membrane is attached to the frame, the weight and cut of the membrane forces beam 615*c* to straighten substantially, thereby increasing the tension within the frame. Tension provided by the guy wires also contributes to this straightening effect. It is noted that FIG. 6 depicts the beam prior to being loaded by the membrane or guy wire-tension.

Optionally, the structure may have all of its beams bowed, or some subset of its beams bowed. For instance, it is may be sufficient to have just one beam of a frame bowed. This can be accomplished by employing corner elements with canted corner angles just for that beam while the remaining corner elements have standard corner angles.

Figure 7:
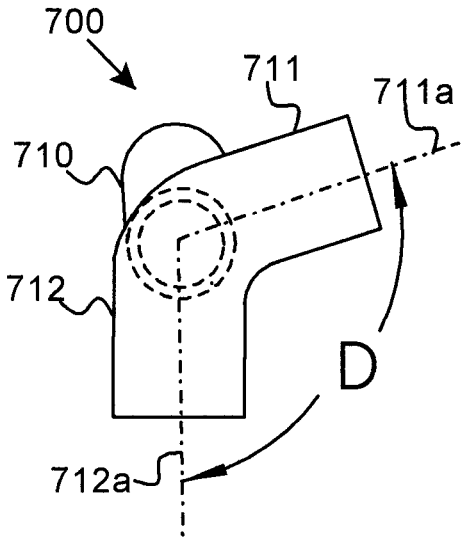
FIG. 7. is a side elevation of a corner element according to a preferred embodiment of the invention.
Figure 8:
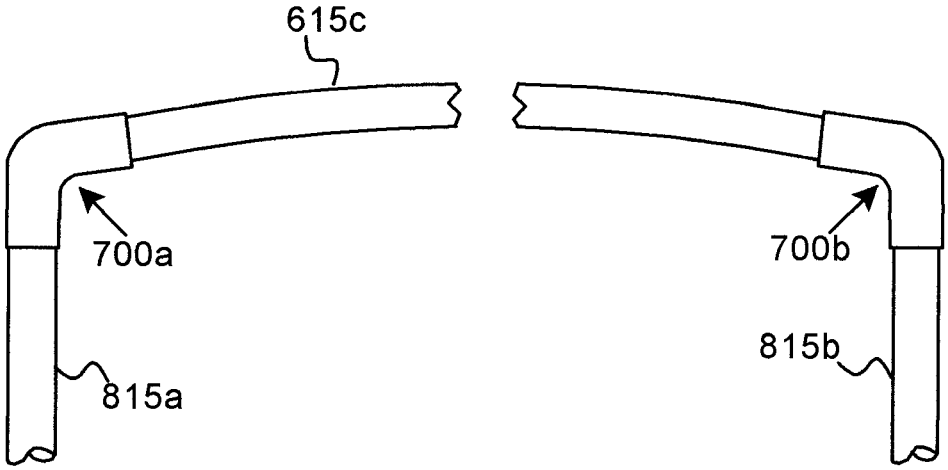
FIG. 8. is a side elevation of a beam attached to two corner elements according to the invention.

Similarly, tension can be introduced into the frame by providing canted leg angles as shown in FIGS. 7-8. FIG. 7 shows a corner element 700 from a side view. From this view, arm 711 and leg 712 can be seen. The arm and leg each has an axis, 711*a* and 712*a*, respectively.

The leg angle "D" between axis 712*a* and the axis 711*a* is canted, that is, it is greater than 90°. An angle of about 96° is preferred for many applications, however the optimum angle will depend on numerous variables as discussed above with respect to canted corner angles.

As shown in FIG. 8, because of the canted leg angle of the corner elements 700*a* and 700*b*, when posts 815*a* and 815*b* are forced into a vertical position, beam 615*c* bows upwards. The beam is also forced to bow outwards slightly. When the membrane is attached to the frame and/or tension is applied by the guy wires, the beam is forced back into a substantially straight configuration, thereby introducing additional, beneficial tension into the structure.

By way of example, in a cross-cable square tent embodiment where 2½" diameter tubing is used for the beams and posts, the leg angle is canted such that the upward bowing induced in the beams is at an optimum when the posts are vertical. In a preferred embodiment the plane of the arms is angled upwards from the horizontal by approximately 5°; however, this value will vary according to frame materials, conditions, uses, and other factors.

Assembly

A tensile frame structure according to the present invention and having n sides and corners is assembled as follows. A membrane, n beams, n posts, and n corner elements are provided. One or more of the corner elements have at least one splayed arm that results in at least one canted corner angle. Optionally or alternatively one or more corner elements may have legs that are splayed to produce canted leg angles, as disclosed above.

The ends of each beam are connected to the arms of the corner elements to form the basic polygonal frame. Because the corner angles are canted, the beams are bowed slightly before the membrane is attached. As with the prior art structures, a certain amount of play in the connections is necessary in order for the frame to be easily assembled. However, as a result of the canted corner angles and/or leg angles, this play does not cause or contribute to a sagging of the beams once the frame is fully assembled, as it does in the prior art. If the structure is a cross-cable tent, the internal cables are attached to the corner elements and tensioned. The membrane is attached to the frame and secured. The posts are attached to the legs and the frame is raised into position with the frame substantially horizontal. The posts are forced into vertical alignment and the bottoms are fixed into position. If the leg angles of the corner elements are canted, the beams are bowed upward slightly until the membrane is attached. The flying pole(s) are then inserted between the internal cables and the membrane. This further tensions the membrane and defines the peak(s) of the tent roof. Optionally, walls may be attached. The weight of the membrane and walls forces the beams to straighten. Depending on several factors, the beams may acquire an absolute straight configuration or they may remain slightly bowed. The result is that the beams are placed under additional tension that counteracts beam-sagging experienced by existing art tents.

It is generally desirable to anchor the lower ends of the posts to the ground to prevent drifting or movement of the tent due to wind, the slope of the ground, etc. This may be done by inserting the end of the post into the ground, attaching the post to a footing, anchoring the post to a stake or fixed object, or by any of a number of other known techniques. Whether it is necessary to secure the posts to prevent them from splaying outwards will depend on factors such as the degree of canting of the corner elements and the length of the posts and beams. In some instances simply exerting downward pressure on the frame of the tent by tying it down to stakes may be sufficient to brace the lower ends of the posts against the ground.

Details and Refinements

For any given tent configuration, the desired corner angle and leg angle will vary according to such factors as the material from which the frame is made, the size of the frame, the size and weight of the membrane, and the demands and requirements of user. Also maximum design loads limit the amount of permissible outward and upward bowing of the beams.

In addition, the degree of outward splaying of the corner element leg may be dictated by other considerations. For example, in certain embodiments it is desired that the frame parts are interchangeable throughout a family of tent sizes and, consequently, certain parameters such as corner and leg angles must be universal, meaning they will not be optimal for all situations. Furthermore, limitations in the amount of bowing of the beams and posts may be set in order to ensure that excessive force is not needed to assemble the tent frame. For example, the angles of the corner elements may be limited such that the frame can be assembled by hand by one or two persons without the use of tools.

It is not possible to provide parameters of the corner elements that will be applicable to all situations; however, from these disclosures it will be possible for those of skill in the art to practice my invention without undue or unreasonable experimentation. Examples of corner angles and leg angles of the frame before attachment of the membrane are provided here as guidelines, as these angles have been found to be optimum under many conditions. However, it is stressed that these are but examples and are not limitations on the practice of the invention.

In a square or rectangular structure, preferred corner angles may be from about 92° to about 97°, and preferred leg angles may be from about 96° to about 100°

In a hexagonal structure, preferred corner angles may be from about 122°- to about 127°, and preferred leg angles may be from about 100° to about 105°.

With larger sized tents bearing larger loads, it will likely be necessary to employ thicker, more robust beams to prevent localized damage at the high moment regions closest to the corner elements.

Although not disclosed herein, the invention does not exclude other features known in the art of corner elements such as loops or orifices for receiving guy wires or other cables. The present invention easily accommodates the use of highly tensioned tent walls, which may affect the choice of corner angle and leg angle parameters.

SUMMARY

While this invention has been described with reference to illustrative embodiments, this description is not intended to be construed in a limiting sense. As a result of this disclosure, the manner of making and using the invention will be obvious to those of skill in the art, as will various modifications of the illustrative embodiments and other embodiments of the invention.

The invention claimed is:

1. A polygonal frame tensile structure, including a polygonal frame comprising:

corner elements having:

a first beam connector arm;

a second beam connector arm; and a post connector leg;

the first and second beam connector arms and the post connector leg all being unitary so as to form a single piece, and the first beam connector arm and the second beam connector arm forming a corner angle and the post connector leg forming a leg angle with the first beam connector arm, at least one of the corner angle and the leg angle of at least a first corner element being canted;

generally vertical posts connected to the post connector leg of the corner elements; and beams connected between said corner elements to form the polygonal frame, including a beam having one end connected to the first beam connector arm of the first corner element and an opposite end connected to the second beam connector arm of a second corner element;

whereby the canted angle of the first corner element causes the beam to bow; and wherein the corner angle of each corner element is canted.

2. The polygonal frame tensile structure of claim 1, further comprising a membrane dimensioned to fit over the polygonal frame, wherein weight and tensioning of the membrane at least partially straightens any bowed beam.

3. The polygonal frame tensile structure of claim 1, wherein the leg angle of each corner element is canted.

4. The polygonal frame tensile structure of claim 3, wherein the canted leg angle is less than 100°.

5. The polygonal frame tensile structure of claim 1, wherein the beam having one end connected to the first beam connector arm of the first corner element and an opposite end connected to the second beam connector arm of a second corner element is a single beam.

6. The polygonal frame tensile structure of claim 1, wherein the first beam connector arm defines a receptacle, wherein the second beam connector arm defines a receptacle, and wherein said beam has one end terminating in a first terminus and has an opposite end terminating in a second terminus, the first terminus being received in the receptacle of the first beam connector arm of the first corner element and the second terminus being received in the receptacle of the second beam connector arm of a second corner element.

7. A method of assembling a horizontal frame tensile structure ("HFTS"), wherein said HFTS has a substantially horizontal polygonal frame with n sides, said method comprising the steps of:

a. providing a membrane;

b. providing n beams;

c. providing n posts;

d. providing n corner elements, each of the corner elements including a first beam connector arm, a second beam connector arm, and a post connector leg, the first and second beam connector arms and the post connector leg all being unitary so as to form a single piece, and the first beam connector arm and the second beam connector arm forming a corner angle and the post connector leg forming a leg angle with the first beam connector arm, the corner angle or the leg angle of at least a first corner element being canted;

e. connecting the beams to the beam connector arms such that each of the beams is connected between beam connector arms of two different corner elements;

f. connecting the posts to the post connector legs such that each of the posts is connected to a post connector leg of a corner element;

g. erecting the structure, whereby the posts are generally vertical and a beam connected between the first corner element and a second corner element is bowed as a result of the canted angle; and, h. attaching the membrane to the frame, whereby the bowed beam is at least partially straightened;

wherein the corner angle of each corner element is canted.

8. The method of claim 7, wherein the leg angle of each corner element is canted, and wherein erecting the structure includes forcing the posts toward a vertical position to cause the beam connected between the first corner element and the second corner element to bow.

9. The method of claim 7, wherein the canted leg angles are less than 100°.

10. The method of claim 7, wherein both the corner angle and the leg angle of each corner element are canted.

11. The method of claim 7, wherein each beam has one end terminating in a first terminus and has an opposite end terminating in a second terminus, the first terminus being received in the receptacle of the first beam connector arm of one corner element and the second terminus being received in the receptacle of the second beam connector arm of an other corner element, whereby each of the beams is bowed.

12. A horizontal frame tensile structure ("HFTS") having n sides, said HFTS comprising:

a. n beams;

b. n posts;

c. n corner elements, each of the corner elements including a first beam connector arm defining a receptacle, a second beam connector arm defining a receptacle, and a post connector leg, the first beam connector arm and the second beam connector arm forming a corner angle and the post connector leg forming a leg angle with each of the beam connector arms, at least one of the corner angle and the leg angle of at least a first corner element being canted; and d. a membrane;

wherein said beams, posts, and corner elements are interconnected to form a substantially horizontal polygonal frame, with each post being generally vertical and being connected to a post connector leg of a respective corner element, and with each beam connected between beam connector arms of corner elements, including a beam having one end terminating in a first terminus and having an opposite end terminating in a second terminus, the first terminus being received in the receptacle of the first beam connector arm of the first corner element and the second terminus being received in the receptacle of the second beam connector arm of a second corner element, whereby said beam connected between the first corner element and the second corner element is bowed;

wherein weight and tensioning of the membrane at least partially straightens the bowed beam; and wherein the corner angle of each corner element is canted.

13. The horizontal frame tensile structure of claim 12, wherein the leg angle of each corner element is canted.

14. The horizontal frame tensile structure of claim 13, wherein the canted leg angles are less than 100°.

15. The horizontal frame tensile structure of claim 12, wherein the beam connected between the first corner element and a second corner element is a single beam.

16. A polygonal frame tensile structure, including a polygonal frame comprising:

corner elements having:

a first beam connector arm defining a receptacle;

a second beam connector arm defining a receptacle; and a post connector leg;

the first beam connector arm and the second beam connector arm forming a corner angle and the post connector leg forming a leg angle with the first beam connector arm, at least one of the corner angle and the leg angle of at least a first corner element being canted;

generally vertical posts connected to the post connector leg of the corner elements; and beams connected between said corner elements to form the polygonal frame, including a beam having one end terminating in a first terminus and having an opposite end terminating in a second terminus, the first terminus being received in the receptacle of the first beam connector arm of the first corner element and the second terminus being received in the receptacle of the second beam connector arm of a second corner element;

whereby the canted angle of the first corner element causes the beam to bow; and wherein the corner angle of each corner element is canted.

17. The polygonal frame tensile structure of claim 16, further comprising a membrane dimensioned to fit over the polygonal frame, wherein weight and tensioning of the membrane at least partially straightens any bowed beam.

18. The polygonal frame tensile structure of claim 16, wherein the leg angle of each corner element is canted.

19. The polygonal frame tensile structure of claim 18, wherein the canted leg angle is less than 100°.

20. The polygonal frame tensile structure of claim 7, wherein the beam having one end connected to the first beam connector arm of the first corner element and an opposite end connected to the second beam connector arm of a second corner element is a single beam.

* * * * *